US006210186B1

(12) United States Patent
Fink et al.

(10) Patent No.: US 6,210,186 B1
(45) Date of Patent: Apr. 3, 2001

(54) CAPTURED CONNECTOR ASSURANCE COMPONENT FOR AN ELECTRICAL CONNECTOR

(75) Inventors: Randy L. Fink, Warren; Mike P. Cummings, Canfield, both of OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/407,127

(22) Filed: Sep. 27, 1999

(51) Int. Cl.[7] ..... H01R 13/62
(52) U.S. Cl. ..... 439/157
(58) Field of Search ..... 439/157, 347, 439/752, 595, 701

(56) References Cited

U.S. PATENT DOCUMENTS 5,569,040 * 10/1996 Sumida ..... 439/157
5,775,957 7/1998 Fink et al. ..... 439/752
5,938,458 * 6/1998 Krehbiel et al. ..... 439/157

* cited by examiner

*Primary Examiner*—Brian Sircus
*Assistant Examiner*—Javaid Nasri
(74) *Attorney, Agent, or Firm*—Richard A. Jones

(57) ABSTRACT

A female electrical connector (100) having a connector position assurance (CPA) component (130) which is permanently captured thereto. A female electrical connector includes a prestage CPA lock mechanism (142) composed of a lock seat (144) formed in a CPA component (130) interfaced with a torsional lock (146) of the female electrical connector. The torsional lock is composed of a prestage lock finger (148) having a lock boss (154), a prestage lock release finger (150) and a torsion pivot (152) connected with a slide assist cover (106) of the female electrical connector and joined with both the prestage lock finger and the prestage lock release finger. The lock boss is interferingly received in the lock seat while the slide assist cover is at a prestaged position, and the lock boss moved out of the lock seat responsive to the slide assist cover reaching a staged position.

1 Claim, 7 Drawing Sheets

CAPTURED CONNECTOR ASSURANCE COMPONENT FOR AN ELECTRICAL CONNECTOR

TECHNICAL FIELD

The present invention relates to electrical connectors and more particularly to a captured connector position assurance component thereof.

BACKGROUND OF THE INVENTION

Referring to FIGS. 1 through 5 a prior art female electrical connector is depicted, which is described in U.S. Pat. No. 5,775,957, issued on Jul. 7, 1998 to Fink et al, the disclosure of which is hereby incorporated herein by reference. This patent describes a female connector 15 and a male connector 20 which are mutually mated via sliding movement of a slide assist cover 12.

The general structural details are set forth in U.S. Pat. No. 5,775,957 and need not be recounted in detail herein. However, with reference to FIGS. 1 and 2, an overall description of the electrical connectors will be derived therefrom (see generally Column 3, line 41 through Column 4, line 16).

To mutually mate female and male connectors 15 and 20, a U-shaped slide 14 is first snapped into position into the slide assist cover 12. A connector position assurance (CPA) component 10 is also snapped in place in a CPA holder 60 molded on the exterior of the slide assist cover 12. With the slide 14, CPA component 10 and the slide assist cover 12 so assembled, the slide is inserted into slots 62 and 64 in an outer housing 28 from the end 66 thereof, and then slid in place until the front surface 68 of the slide assist cover 12 bumps against the front of a CPA lock feature 70, located on a cantilever arm 72 on the top of a wire shroud 18. In this position, the male connector 20 is ready to be mated to the female connector 15, wherein four slot inlets of the slide 14 are aligned with four slots of the outer housing. The slide assist cover 12 is now at its prestaged position relative to the outer housing 28 and the wire shroud 18.

The male connector 20 is then aligned so that the tabs 4, 6, 8 and 11 enter the slots, beginning engagement of the male terminals 22 to the female terminals 40. Force is then applied on the assist cover 12 to move the slide more into the outer housing 28. Deflection of the cantilever arm 72 is necessary to allow the front surface 68 past the CPA lock feature 70. Through the resulting motion, four inner slot ramps of, respectively, the slot inlets of the slide 14 act on the tabs 4, 6, 8, and 11, forcing the male connector into full engagement with the female connector. The slide assist cover 12 is now at its staged position relative to the outer housing 28 and the wire shroud 18.

During this process, the CPA lock feature 70 is forced underneath the side 82 of the slide assist cover 12 through cantilevering action of cantilever arm 72. The male/female connectors 20 and 15 are not fully engaged until the CPA lock feature 70 pops into an opening 84 in the slide assist cover 12, wherein a locking port 75 thereof is aligned with the slide axis of the CPA component 10. Once in this position the CPA component 10 can be slid forward from its engagement position in the CPA holder 60 to a snap-lock position in the locking port 75 of the CPA lock feature 70, whereat the CPA component is also lodged in a docking port 85 (see FIG. 3) of a CPA docking feature 86 of the side 82 of the slide assist cover 12.

If the CPA component 10 cannot be slid forward and snap into the snap-lock position in the CPA lock feature 70, then the male and female connectors 20, 15 are not completely mutually engaged. Once the CPA component 10 is slid and locked into position in the CPA lock feature, the male and female terminals are in contact and the male and female connectors are locked in place. The male and female connectors will remain locked in place and cannot be disengaged from each other until the CPA component 10 is slid out from the CPA lock feature 70.

FIGS. 3 and 4 depict the functioning of the CPA component 10 to assure connector assurance when it is slid from its prestaged position, shown at FIG. 3, to its staged position, shown at FIG. 4.

As shown at FIG. 3, the CPA component 10 has a pair of opposed CPA bosses 24 which are received into respective CPA indents 30 of the CPA holder 60. The slide assist cover 12 is shown fully slid into final position as shown at FIG. 2, wherein the CPA lock feature 70 is received up into the opening 84. The CPA component 10 is at its prestaged position.

Now, as shown at FIG. 4, the CPA component 10 has been slid through the locking port 75 of the CPA lock feature 70 and partly into the docking port 85 of the CPA docking feature 86. The CPA component 10 is locked in the staged position via the CPA bosses 24 interferingly abutting respective CPA bossments 26 of the CPA lock feature 70.

While the function of the connector 15 is very admirable, it suffers from the possibility of the CPA component 10 becoming separated from the slide assist cover 12 when the CPA component 10 is prestaged at the CPA holder 60 and the slide assist cover is at its prestaged position, as shown at FIG. 1. This untoward situation is depicted at FIG. 5, wherein the CPA component 10 has been dislodged from the CPA holder 60. Because only the opening 84 is adjacent the CPA holder 60 (the CPA lock feature 70 being absent from the opening), the CPA component 10 can fall free of the female connector 15.

Accordingly, what is needed is to prevent the CPA component from being separated from the female component.

SUMMARY OF THE INVENTION

The present invention is a female electrical connector having a CPA component which is permanently captured thereto.

A female electrical connector is substantially as described in U.S. Pat. No. 5,775,957, wherein the improvement thereto is a prestage CPA lock mechanism composed of a lock seat formed in a CPA component interfaced with a torsional lock of the female electrical connector. The torsional lock is composed of a prestage lock finger, a prestage lock release finger and a torsion pivot connected with a slide assist cover of the female electrical connector and joined with both the prestage lock finger and the prestage lock release finger.

In operation, when the CPA component is prestaged in a CPA holder of the slide assist cover, a lock boss of the prestage lock finger is seated interferingly into the lock seat of the CPA component, thereby preventing it from sliding out of the CPA holder. As the slide assist member is slid relative to an outer housing of the female electrical connector, an abutment surface thereof strikes the prestage lock release finger, causing the torsional lock member to rotate via torsioning at the torsion pivot. Upon the slide assist cover reaching its staged position, the lock boss is moved out of interference with the lock seat. Now the CPA component can be slide through a CPA lock feature in the manner known in U.S. Pat. No. 5,775,957.

Accordingly, it is an object to permanently capture a CPA component onto an electrical connector.

This, and additional objects, advantages, features and benefits of the present invention will become apparent from the following specification.

DESCRIPTION OF THE PREFERRED EMBODIMENT

Figure 1:
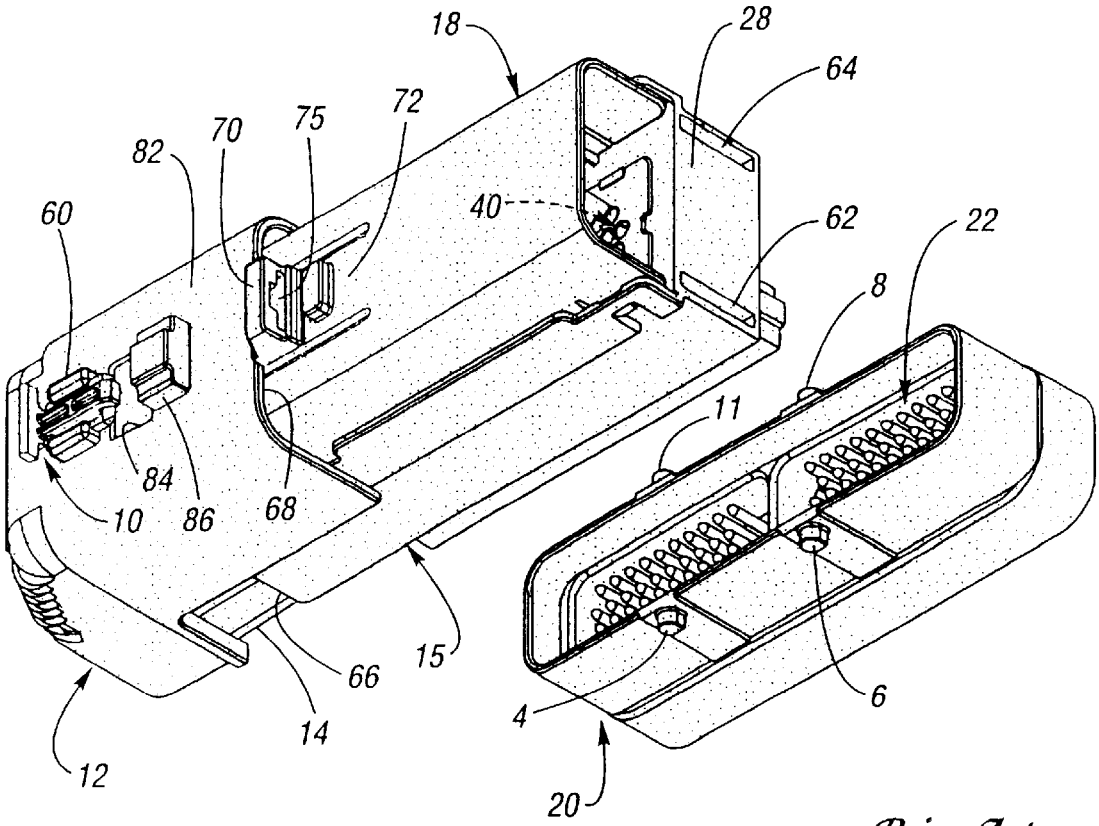
Prior Art Fig. 1
FIG. 1 is a perspective view of prior art female and male electrical connectors prior to mating.
Figure 2:
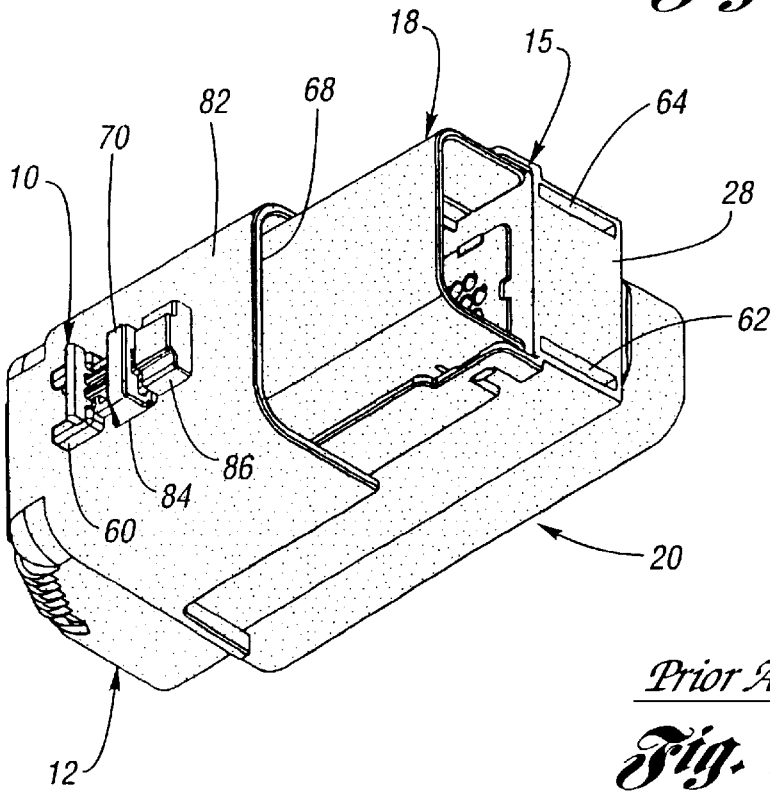
Prior Art Fig. 2
FIG. 2 is a perspective view of the prior art female and male electrical connectors mated to each other.
Figure 3:
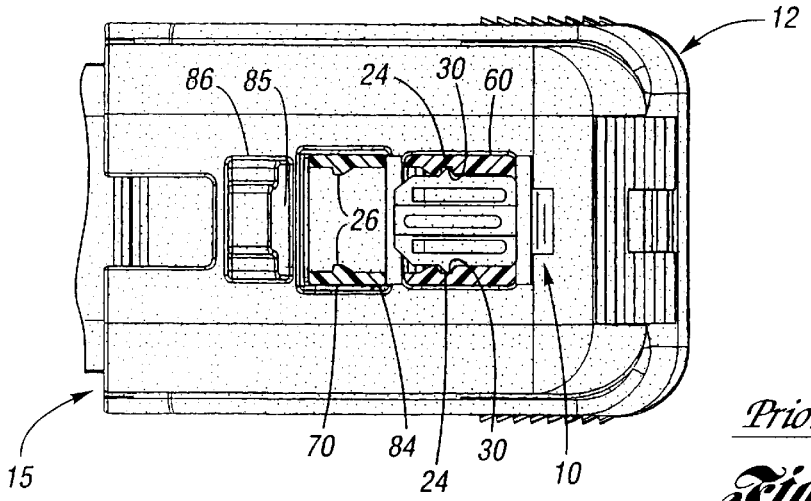
Prior Art Fig. 3
FIGS. 3 through 5 depict various views of the CPA component of the female electrical connector of FIGS. 1 and 2.
Figure 4:
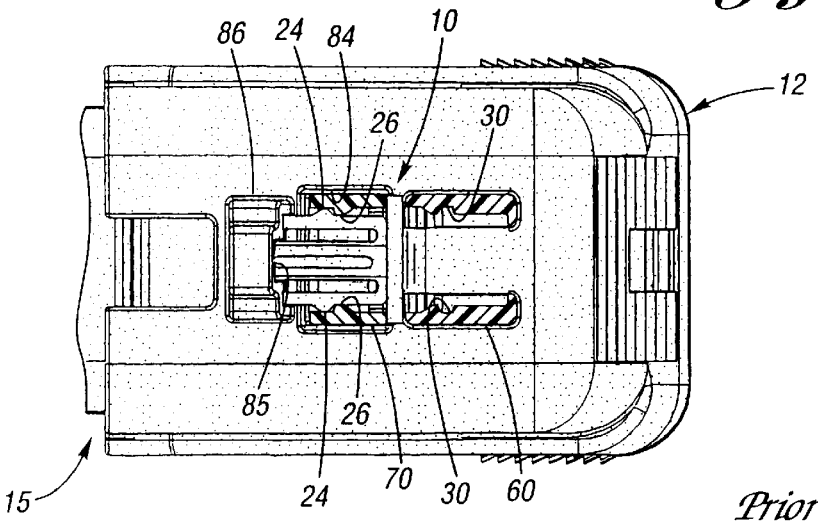
Prior Art Fig. 4
Figure 5:
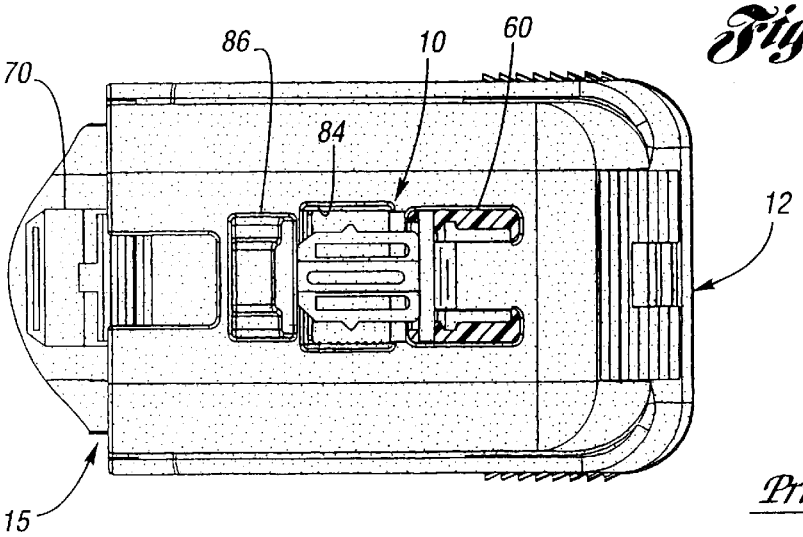
Prior Art Fig. 5

Referring now to the Drawings, FIGS. 6 through 11E depict various views of the female electrical connector 100 according to the present invention, which as excepted by the disclosure hereinbelow, is structurally and operatively described in U.S. Pat. No. 5,775,957, in view of the above incorporation by reference herein of which, a detailed disclosure is obviated. The various improvements thereto may be discerned from a reading of the following specification and an inspection of FIGS. 6 through 11E.

Figure 6:
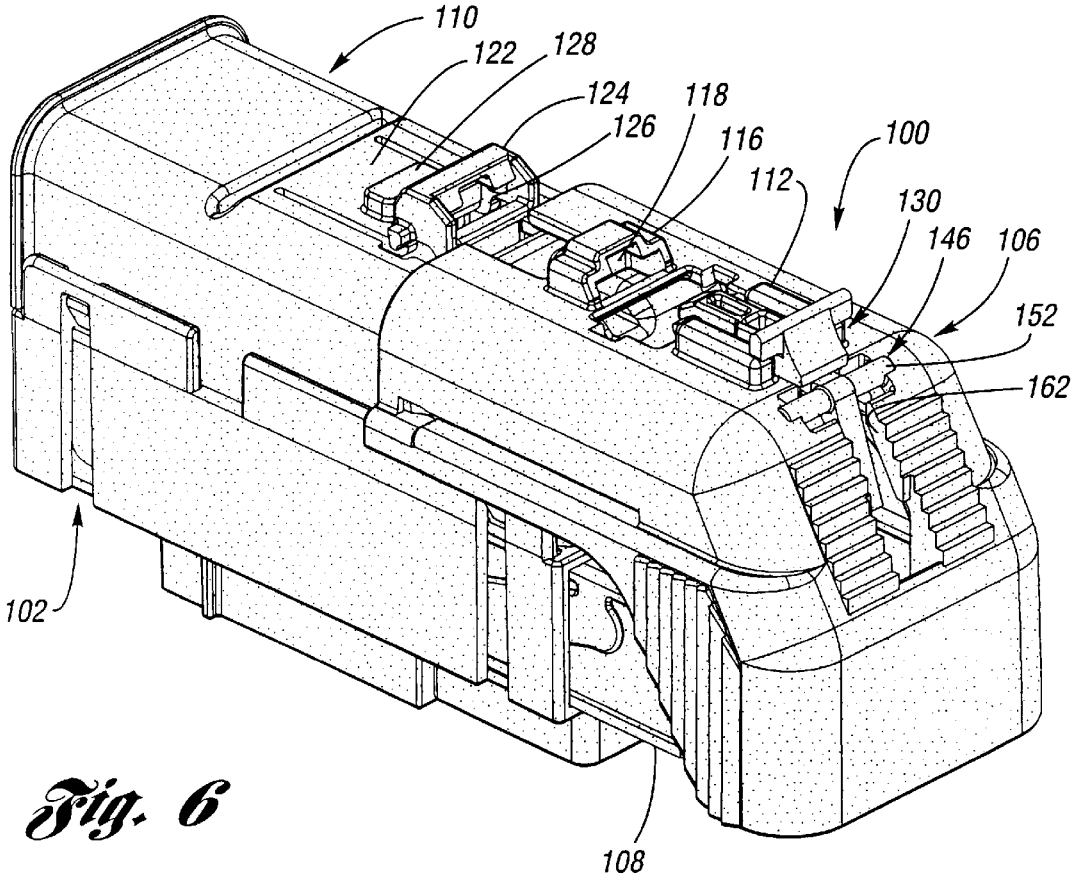
FIG. 6 is a perspective view of a female electrical connector according to the present invention, wherein the slide assist cover and CPA component thereof are both prestaged.
Figure 7:
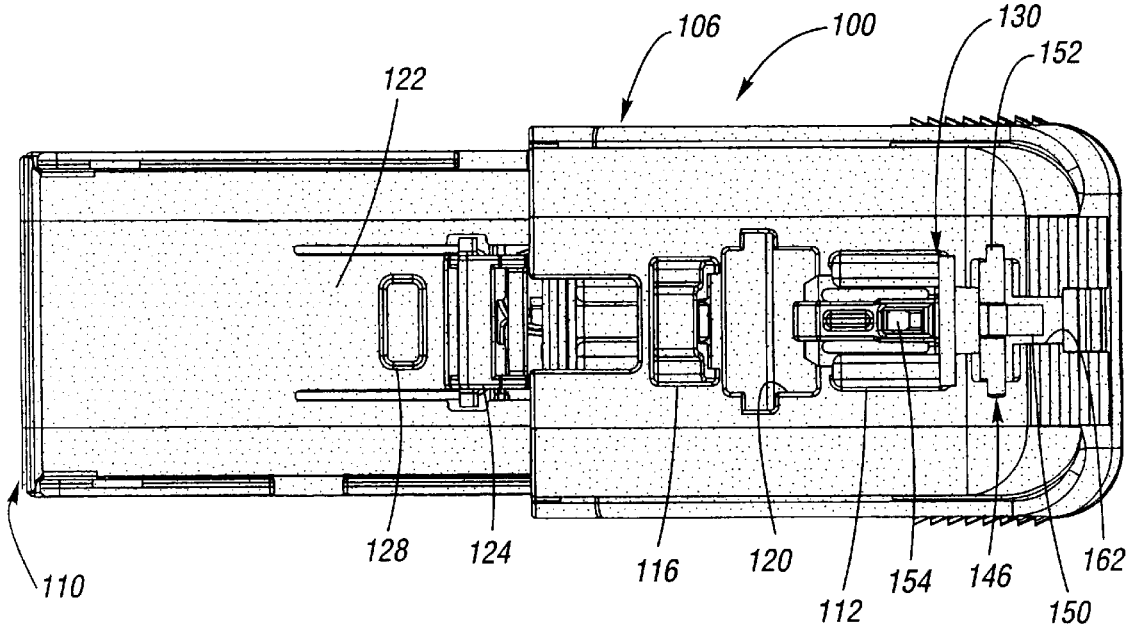
FIG. 7 is a top plan view of the female electrical connector of FIG. 6.
Figure 8:
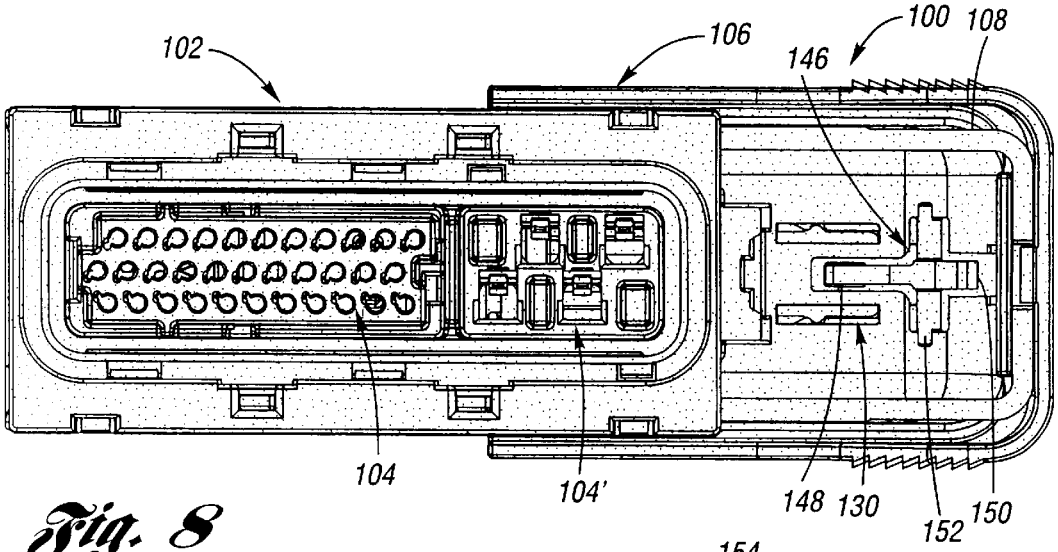
FIG. 8 is a bottom plan view of the female electrical connector of FIG. 6.
Figure 9:
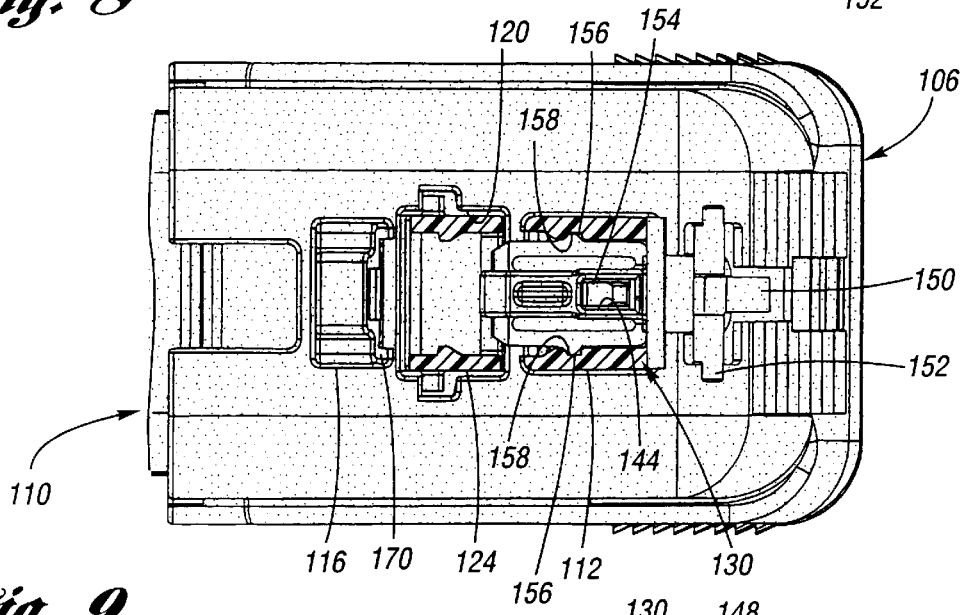
FIG. 9 is a partly sectional, partly broken away, top plan view of the female electrical connector according to the present invention, wherein the slide assist cover is staged and the CPA component is prestaged.
Figure 10:
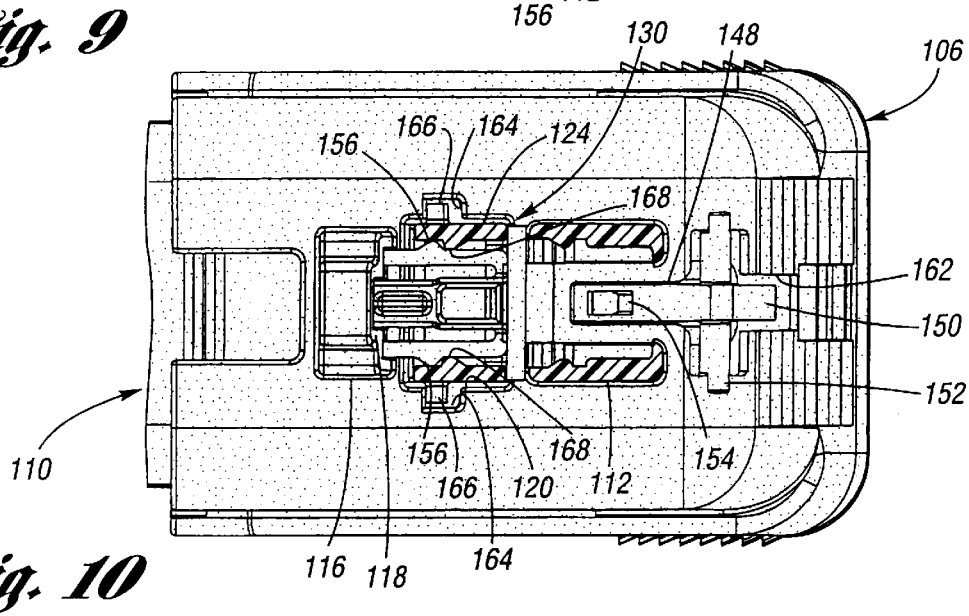
FIG. 10 is a partly sectional, partly broken away, top plan view of the female electrical connector according to the present invention, wherein both the slide assist cover and the CPA component are staged.

The female electrical connector 100 includes an outer housing 102 which receives a plurality of terminals 104, 104' and a slide assist cover 106 having a slide 108 which, when slid relative to the outer housing, causes a male electrical terminal (not shown) to be seated with respect to the female electrical terminal. The female electrical connector 100 further includes a wire shroud 110 affixed to the outer housing 102. The slide assist cover 106 includes a CPA holder 112, a docking feature 116 having a docking port 118 and an opening 120 formed between the CPA holder and the CPA docking feature. The wire shroud 110 has a cantilever arm 122 at the end of which is located a CPA lock feature 124 having a locking port 126. A CPA lock nib 128 is located on the cantilever arm 122 adjacent the CPA lock feature 124. A CPA component 130 is prestaged at the CPA holder 112, wherein FIGS. 6 through 8 depict both the slide assist cover 106 and the CPA component prestaged.

In order that the CPA component 130 remains prestaged in the CPA holder 112 until the slide assist cover 106 is staged, a prestage CPA lock mechanism 142 is provided. The prestage CPA lock mechanism 142 includes a lock seat 144 formed in the CPA component 130 which is interfaceable in an interfering manner with a torsional lock 146 of the slide assist cover 106. The torsional lock 146 is composed of a prestage lock finger 148, a prestage lock release finger 150 and a torsion pivot 152 integrally connected with a slide assist cover 106 and integrally connected with both the prestage lock finger and the prestage lock release finger. The torsion lock 146 is interferingly interfaced with the CPA component 130 via a lock boss 154 of the prestage lock finger 148 being received into the lock seat 144, wherein the prestage lock finger passes through a lock slot 156 formed in the slide assist cover 106 at the CPA 112 holder and communicating with the holder port 114.

Operation of the CPA prestage lock mechanism 142 will be detailed.

The CPA component 130 is prestaged at the CPA holder 112 of the slide assist cover 106, wherein a pair of opposed CPA bosses 156 of the CPA component are snappingly received into respective CPA indents 158 of the CPA holder, and wherein the lock boss 154 of the prestage lock finger 148 is seated interferingly into the lock seat 144 of the CPA component which thereby prevents the CPA component from sliding out of the CPA holder. The CPA component and the slide assist cover are now both prestaged, and the CPA component is captured on the slide assist cover (see FIGS. 7 and 11A).

Figure 11A:
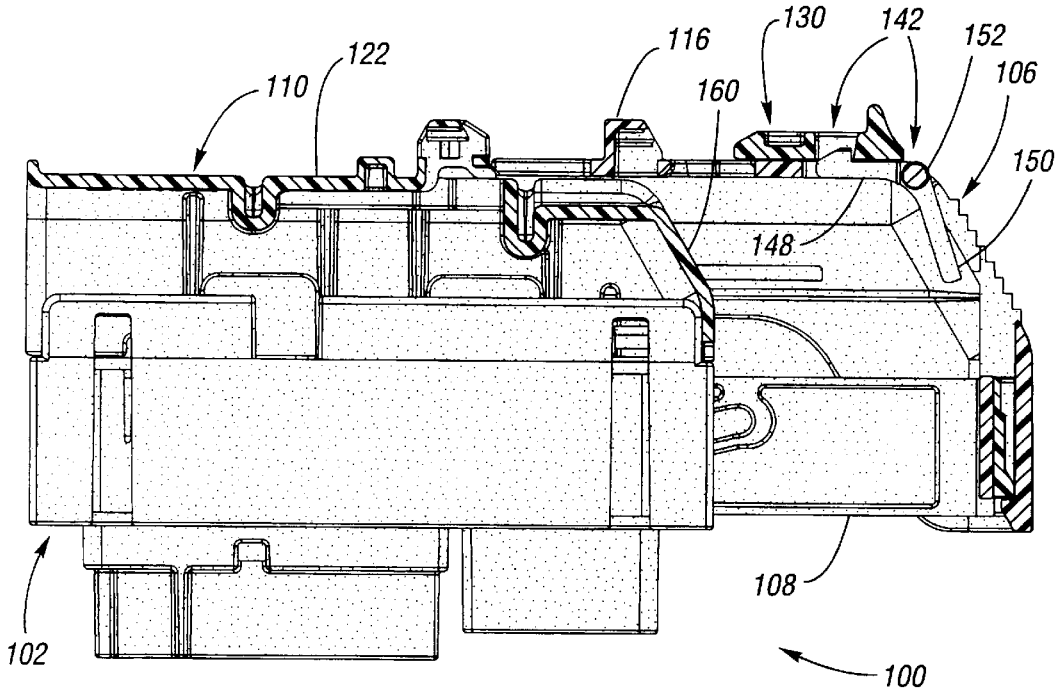
FIGS. 11A through 11E are partly sectional side views of the female electrical connector according to the present invention, depicting operation of the CPA component in conjunction with a prestage CPA lock mechanism.
Figure 11B:
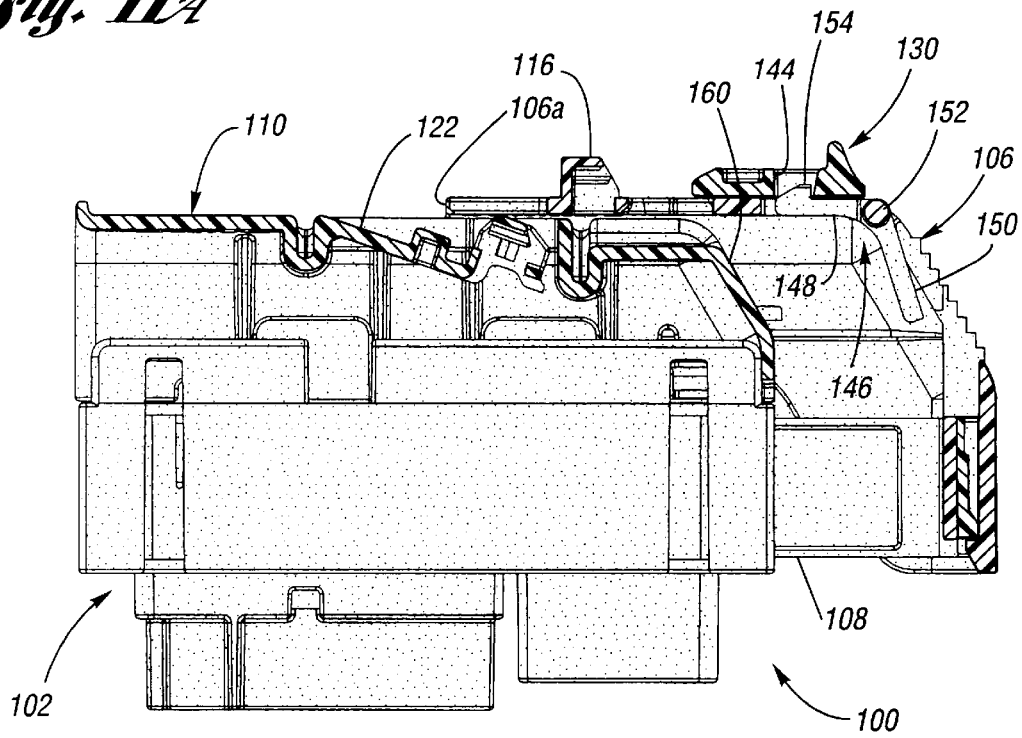
Figure 11C:
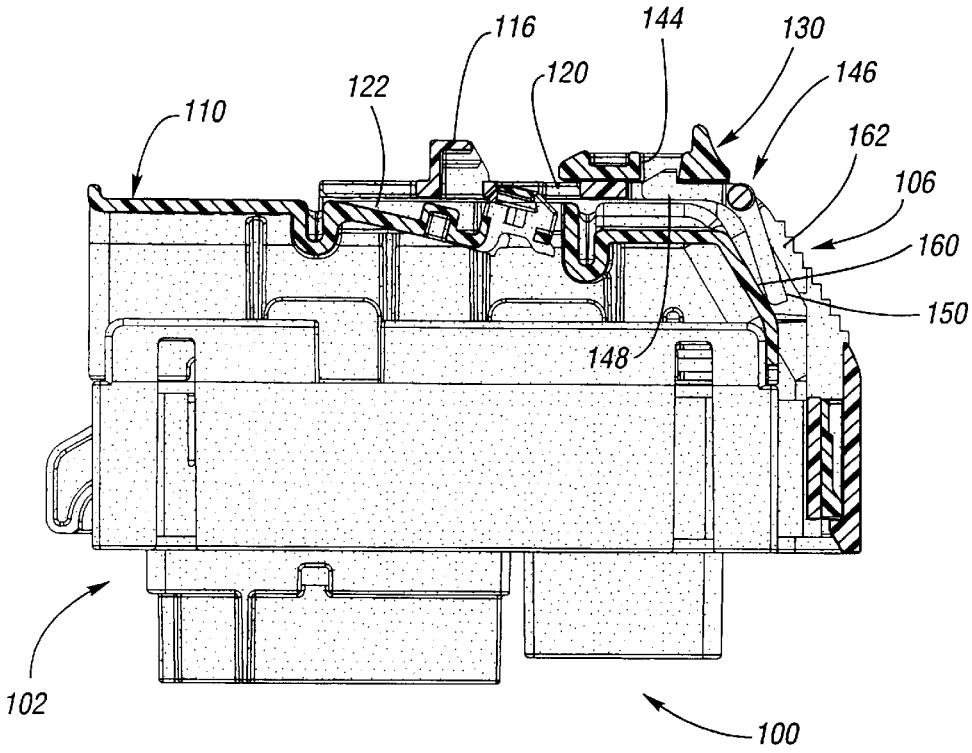
Figure 11D:
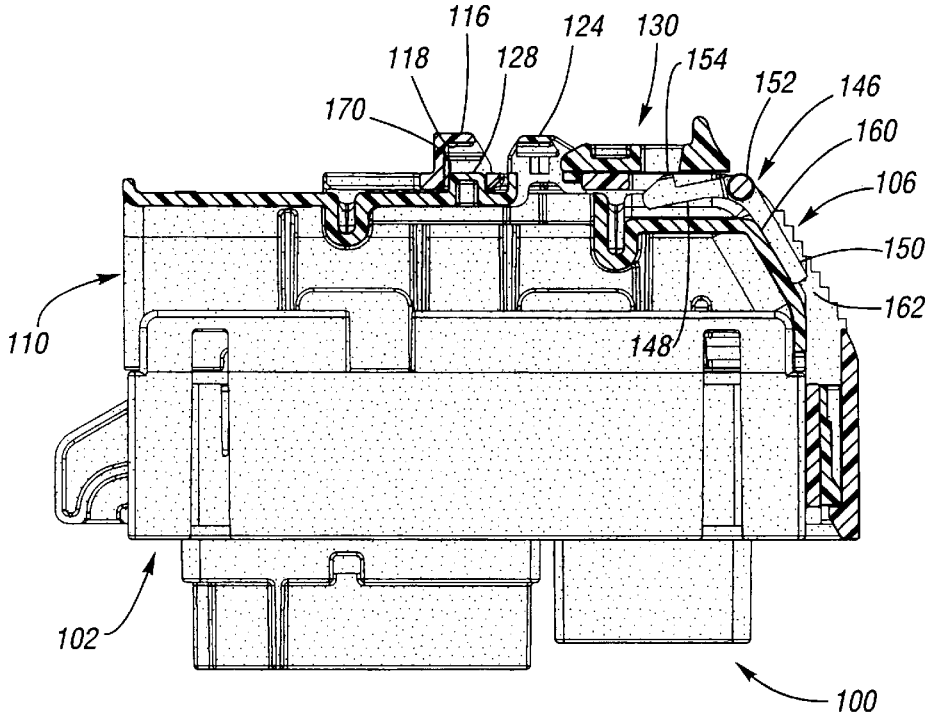
Figure 11E:
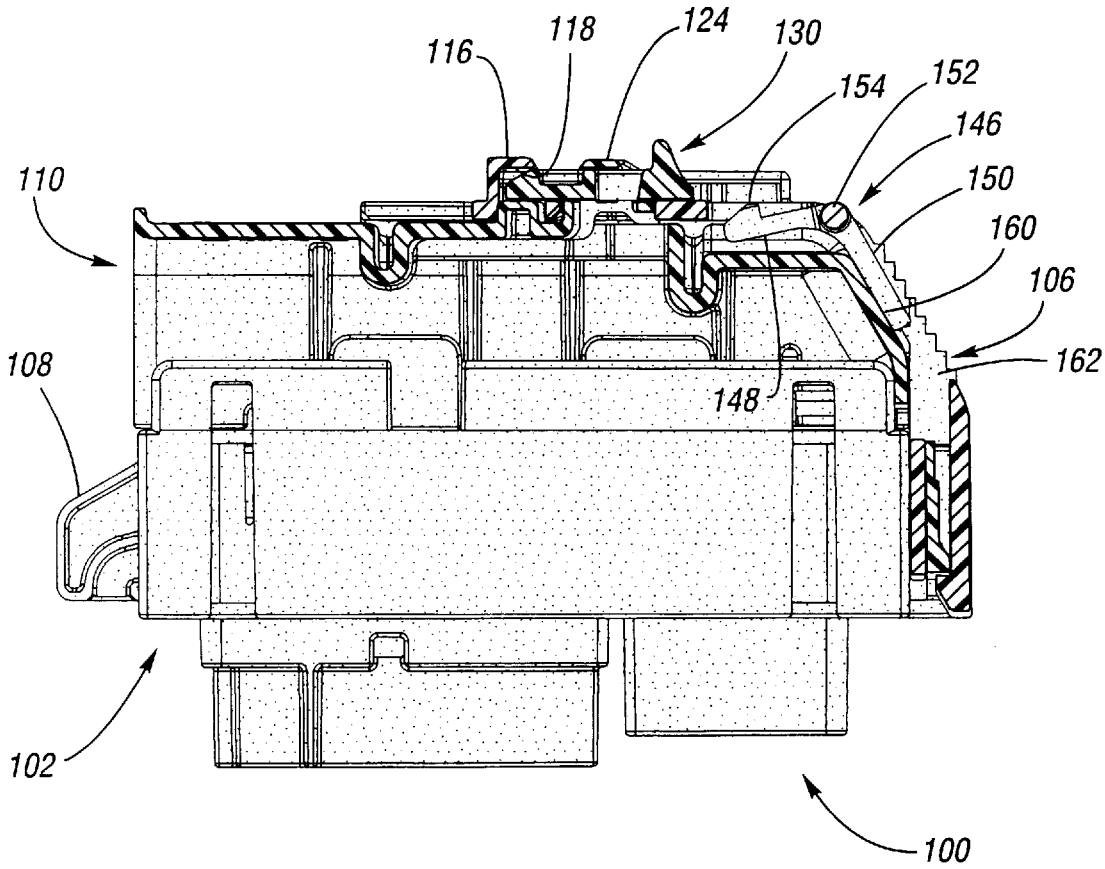

The installer pushes downwardly on the cantilever arm 122 at the CPA lock feature 124 so that the CPA lock feature is moved out from interference with the forward end 106*a* of the slide assist cover, and is now able to move under the slide assist cover as the slide assist cover is slid relative to the outer housing 102 (see FIG. 11B).

As the slide assist cover slides, eventually an abutment surface 160 thereof strikes the prestage lock release finger 150. At this point the torsion pivot is still in a relaxed state, wherein the lock boss received into the lock seat as described above (see FIGS. 11C).

Now, as the slide assist cover is further slid relative to the outer housing, the abutment surface forces the prestage lock release finger to be moved therewith, resulting in the torsion lock 146 rotating and the torsion pivot being twisted torsionally in a reversible, resilient manner. A release slot 162 is provided in the slide assist cover so that the prestage lock release arm may pass thereinto as the slide assist cover reaches its staged position. The rotation of the torsion lock results in the lock boss moving out from the lock seat, and thereby allowing the CPA component to be slid. In this regard, an angular relationship between the prestage lock arm and the prestage lock release arm (for nonlimiting example about 110 degrees) is predetermined so that the abutment surface provides release of the CPA component as described. Further, with the slide assist cover at the staged position, the CPA lock feature pops up into the opening 120 and the lock nib 128 is level with the outer surface of the slide assist cover via its entry into an aperture 170 under the CPA docking feature which communicates with the docking port (see FIGS. 9 and 11D). It will be noted from reference to FIG. 10 that it is preferred for the opening to have a pair of opposed recesses 164 into which respectively seat protuberances 166 of the CPA lock feature 124.

With the slide assist cover at the staged position, the CPA component is now snapped out of the CPA holder and slid through the locking port 126 of the CPA lock feature and partly into the docking port 118 of the CPA docking feature 116. In this regard, the CPA bosses snap interferingly past bossments 168 of the CPA lock feature. The CPA component is now staged (see FIG. 11E).

If the CPA component cannot be slid forward and snapped into the CPA lock feature, then the male and female electrical connectors are not completely mutually engaged. Once the CPA component is slid and locked into position in the CPA lock feature, the male and female terminals are in contact and the male and female connectors are locked in place. The male and female connectors will then remain locked in place and cannot be disengaged from each other until the CPA component is snappingly slid out from the CPA lock feature.

To those skilled in the art to which this invention appertains, the above described preferred embodiments may be subject to change or modification. Such change or modification can be carried out without departing from the scope of the invention, which is intended to be limited only by the scope of the appended claims.

What is claimed is:

1. An electrical connector, comprising:

an outer housing for supporting a plurality of terminals;

a wire shroud connected to said outer housing, said wire shroud having a cantilever arm, a lock feature being formed on said cantilever arm, said look feature having a locking port formed therein;

a slide assist cover slidably connected with said outer housing so as to be slidable between a prestaged position and a staged position, said slide assist cover having a holder formed thereon;

a connector position assurance component slidably interfaced with said slide assist cover so as to be slidable between a prestaged position wherein said connector position assurance component is located at said holder and a staged position whereat said connector position assurance component is received in said locking port; and a prestage connector position assurance lock mechanism for retaining said connector position assurance component at said holder unless said slide assist cover is at its staged position;

wherein said prestage connector position assurance lock mechanism comprises:

a lock seat formed in said connector assurance conmponent;

an abutment surface on said slide assist cover; and a torsion lock torsionally connected with said slide assist cover and interferingly engageable with said lock seat responsive to movement of said slide assist cover; and wherein said torsion lock comprises:

a prestage lock arm having lock boss formed thereon:

a prestage lock release arm; and a torsion pivot connected to each of said prestage lock arm and said prestage lock release arm, said torsion pivot being connected to said slide assist cover;

wherein said lock boss is interferingly received into said lock seat when said torsion pivot is in a relaxed state, and wherein said lock boss is moved out of said lock seat by said abutment surface pressing against said prestage lock release arm when said slide assist cover is moved to its staged position.

* * * * *